US009259923B2

(12) United States Patent
Sasagawa et al.

(10) Patent No.: US 9,259,923 B2
(45) Date of Patent: Feb. 16, 2016

(54) METHOD OF DRIVING LIQUID EJECTION HEAD AND LIQUID EJECTION APPARATUS

(75) Inventors: Naoto Sasagawa, Kawasaki (JP); Koichi Kitakami, Chigasaki (JP); Ryota Kashu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/111,526

(22) PCT Filed: Apr. 13, 2012

(86) PCT No.: PCT/JP2012/002575
§ 371 (c)(1),
(2), (4) Date: Oct. 11, 2013

(87) PCT Pub. No.: WO2012/144175
PCT Pub. Date: Oct. 26, 2012

(65) Prior Publication Data

US 2014/0035978 A1 Feb. 6, 2014

(30) Foreign Application Priority Data

Apr. 19, 2011 (JP) ..... 2011-093070

(51) Int. Cl.
*B41J 29/38* (2006.01)
*B41J 2/045* (2006.01)
*B41J 2/14* (2006.01)

(52) U.S. Cl.
CPC ..... *B41J 2/04581* (2013.01); *B41J 2/04501* (2013.01); *B41J 2/04588* (2013.01); *B41J 2/14233* (2013.01)

(58) Field of Classification Search
CPC ..... B41J 2/04581; B41J 2/04588; B41J 2/04596; B41J 2/14233; B41J 2/14209; B41J 2/04501; B41J 2/14201
USPC ..... 347/9, 10, 11, 68, 6, 14, 70
See application file for complete search history.

(56) References Cited

U.S. PATENT DOCUMENTS

| | | | | |
|---|---|---|---|---|
| 7,374,263 | B2 * | 5/2008 | Hosono | 347/68 |
| 2003/0122889 | A1 | 7/2003 | Okuda | |
| 2007/0229597 | A1 | 10/2007 | Kodama | |

(Continued)

FOREIGN PATENT DOCUMENTS

| | | | |
|---|---|---|---|
| CN | 1475349 | A | 2/2004 |
| CN | 101659152 | A | 3/2010 |
| JP | 4061953 | B2 | 3/2008 |
| JP | 2011-20280 | A | 2/2011 |

(Continued)

*Primary Examiner* — Jannelle M Lebron
(74) *Attorney, Agent, or Firm* — Canon USA, Inc. IP Division

(57) ABSTRACT

A method of driving a liquid ejection head includes preparing a liquid ejection head including first and second flow paths, and a piezoelectric element, a first step of applying a first voltage, which expands the second flow path, to the piezoelectric element while a meniscus of a liquid recessed from an orifice toward the second flow path is formed in a first flow path to move the meniscus to the second flow path, a second step of applying a second voltage, which contracts the second flow path, to the piezoelectric element while the meniscus that moves toward the first flow path is positioned in the second flow path to move the liquid to the first flow path, and a third step of applying a third voltage, which expands the second flow path, to the piezoelectric element to eject the liquid from the orifice after the liquid projects from the orifice.

13 Claims, 18 Drawing Sheets

(56) References Cited

U.S. PATENT DOCUMENTS

2009/0095708 A1 4/2009 Kubota
2010/0253743 A1* 10/2010 Takeuchi ..... 347/47

FOREIGN PATENT DOCUMENTS

JP 2011-37146 A 2/2011
JP 2011-62870 A 3/2011

* cited by examiner

METHOD OF DRIVING LIQUID EJECTION HEAD AND LIQUID EJECTION APPARATUS

TECHNICAL FIELD

The present invention relates to a method of driving a liquid ejection head configured to eject a droplet and relates to a liquid ejection apparatus.

BACKGROUND ART

A liquid ejection head mounted on a liquid ejection apparatus, such as an inkjet printing apparatus, includes an actuator, such as a piezoelectric element, as a generator of energy for ejecting droplets. Such a liquid ejection head is advantageous in that it can eject various types of droplets (ink, for example).

In recent years, liquid ejection apparatuses have been used for diverse purposes, including commercial printing performed by a print on demand (POD) technique. In order to meet the demand for high-speed printing required in commercial printing or the like, an increase in the number of droplets ejected per unit time is required by the liquid ejection head. To this end, the liquid ejection head needs to be driven at high frequencies.

If a liquid that the liquid ejection head ejects on a recordable medium contains a large amount of water, the recordable medium may be deformed (suffer from curling, cockling, or other defects). To prevent such deformation of the recordable medium, using a highly viscous liquid that contains a small amount of water is desirable as the liquid that the liquid ejection head ejects.

However, a highly viscous liquid does not flow easily. Thus, a highly viscous liquid flows slowly in a liquid ejection head that ejects the highly viscous liquid. After the liquid ejection head ejects droplets of the liquid, it takes time to refill the liquid ejection head with the liquid.

In the case of driving the liquid ejection head at high frequencies, there is a need to quickly refill the liquid ejection head with a liquid. If a highly viscous liquid is used here, the liquid ejection head may not be sufficiently refilled with the liquid. If the liquid ejection head is not sufficiently refilled with the liquid, the liquid ejection head may fail to eject droplets.

PTL 1 discloses a technique for quickly refilling a liquid ejection head with a liquid. The liquid ejection head includes individual liquid chambers each connected to an orifice through which droplets are ejected, a common liquid chamber that supplies the liquid to the individual liquid chambers, and a communication portion that allows the common liquid chamber and the individual liquid chambers to communicate with one another.

In the communication portion of the liquid ejection head, multiple triangular prism members each having three sidewalls are vertically disposed. In each prism member, one of the sidewalls faces a corresponding individual liquid chamber and a ridge formed by the other two sidewalls is directed toward the common liquid chamber. Accordingly, the gap between the multiple prism members is narrow on the individual liquid chamber side and wide on the common liquid chamber side.

In this liquid ejection head, the prism members in the communication portion regulate the direction of the liquid flowing from the common liquid chamber to the individual liquid chambers. For this reason, the liquid easily flows from the common liquid chamber to the individual liquid chambers, while the liquid negligibly flows from the individual liquid chambers to the common liquid chamber. Since the liquid ejection head is refilled with the liquid by making the liquid flow from the common liquid chamber to the individual liquid chambers, the liquid ejection head can be quickly refilled with the liquid.

In order that liquid ejection heads can be used for further different applications, liquid ejection heads are required to accept a liquid with a higher viscosity or to be driven at higher frequencies. Specifically, liquid ejection heads are required to eject droplets with a viscosity of 40 cP at a frequency of 50 kHz. In this case, it is difficult for even the liquid ejection head disclosed in PTL 1 to be fully refilled with a liquid flowing from the common liquid chamber to the individual liquid chambers.

CITATION LIST

Patent Literature

PTL 1: Japanese Patent No. 4061953

SUMMARY OF INVENTION

The present invention provides a method of driving a liquid ejection head. The method includes preparing a liquid ejection head, a first step, a second step, and a third step. The liquid ejection head includes an orifice through which a liquid is ejected, a first flow path having a first end connected to the orifice, a second flow path connected to a second end of the first flow path that is opposite the first end and having a larger cross-sectional area than that of the first flow path, and a piezoelectric element provided so as to correspond to the second flow path, the piezoelectric element allowing a droplet to be ejected from the orifice by changing the capacity of the second flow path with a voltage having a predetermined waveform being applied to the piezoelectric element. In the first step, a first voltage, which increases the capacity of the second flow path, is applied to the piezoelectric element while a meniscus of the liquid that is recessed from the orifice toward an inside of the second flow path is formed in the first flow path to move the meniscus to the inside of the second flow path. In the second step, a second voltage, which decreases the capacity of the second flow path, is applied to the piezoelectric element while the meniscus in the second flow path that is moving toward the first flow path is positioned in the second flow path to move the liquid to an inside of the first flow path. In the third step, a third voltage, which increases the capacity of the second flow path, is applied to the piezoelectric element to eject the liquid from the orifice after the liquid in the first flow path projects from the orifice.

DESCRIPTION OF EMBODIMENTS

Figure 1:
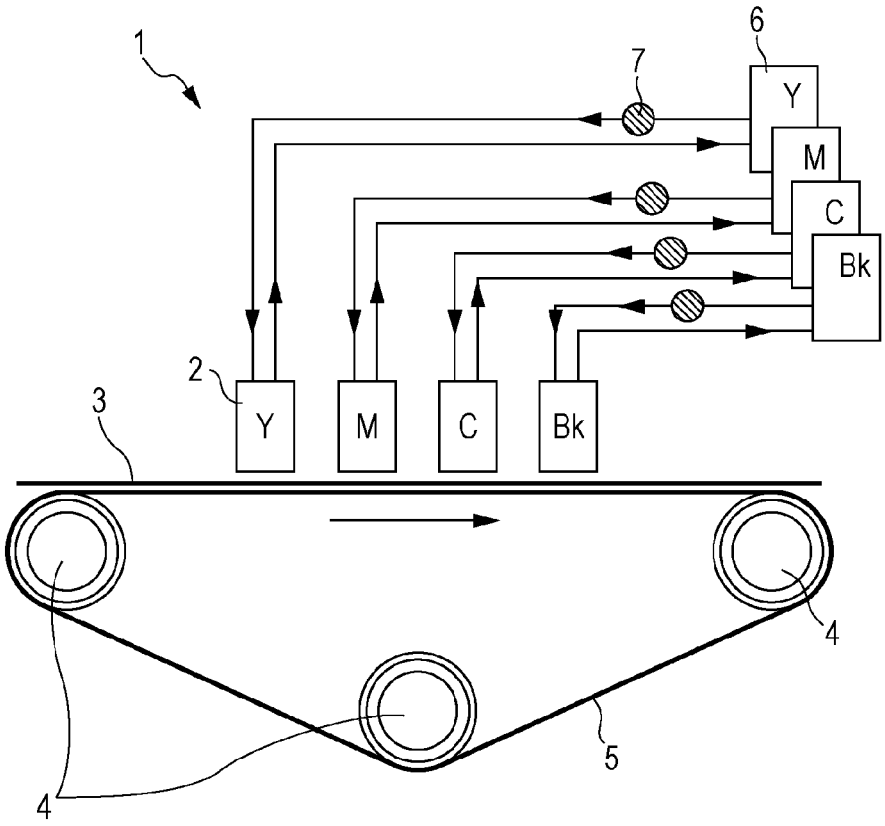
FIG. 1 is a schematic diagram of a liquid ejection apparatus according to a first embodiment of the present invention.

Referring to the drawings, embodiments of the present invention will be described below. Note that the present invention is not limited to the embodiments to be described below.

First Embodiment

A first embodiment of the present invention will be described with reference to the drawings.

FIG. 1 is a schematic diagram of a liquid ejection apparatus 1 according to the first embodiment. The liquid ejection apparatus 1 includes an endless conveying belt 5 that is wound around conveying rollers 4 and on which a recordable medium 3 is placed. The liquid ejection apparatus 1 rotates the conveying belt 5 by a driving force of the conveying rollers 4 and thus conveys the recordable medium 3 in the arrow direction illustrated in FIG. 1.

The liquid ejection apparatus 1 illustrated in FIG. 1 includes four liquid ejection heads 2. The liquid ejection heads 2 are arranged side by side in a direction in which the recordable medium 3 is conveyed. Each liquid ejection head 2 is connected to a corresponding ink tank 6 containing a liquid (ink) of yellow (Y), magenta (M), cyan (C), or black (Bk). The liquid ejection heads 2 that eject inks of different colors may be positioned in any order. A pump 7 that transmits a liquid contained in each ink tank 6 to a corresponding one of the liquid ejection heads 2 is disposed between the liquid ejection head 2 and the ink tank 6.

The liquid ejection apparatus 1 can perform recording on the recordable medium 3 in full color with each liquid ejection head 2 appropriately ejecting the ink of the corresponding color supplied from the corresponding ink tank 6 to the recordable medium 3.

Figure 2A:
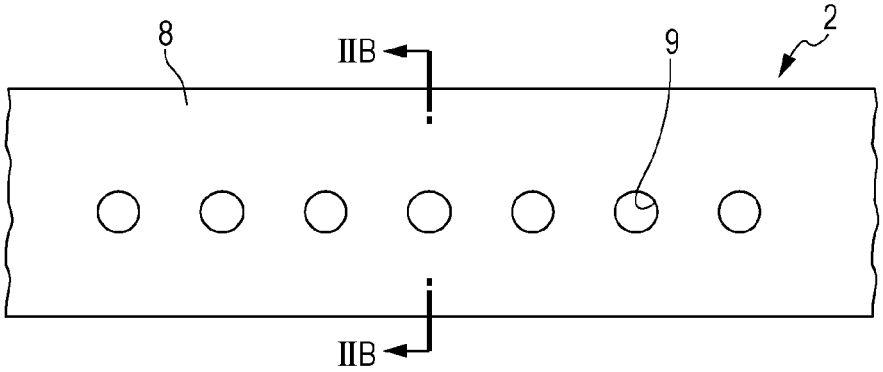
FIG. 2A is a schematic diagram of a liquid ejection head illustrated in FIG. 1.
Figure 2B:
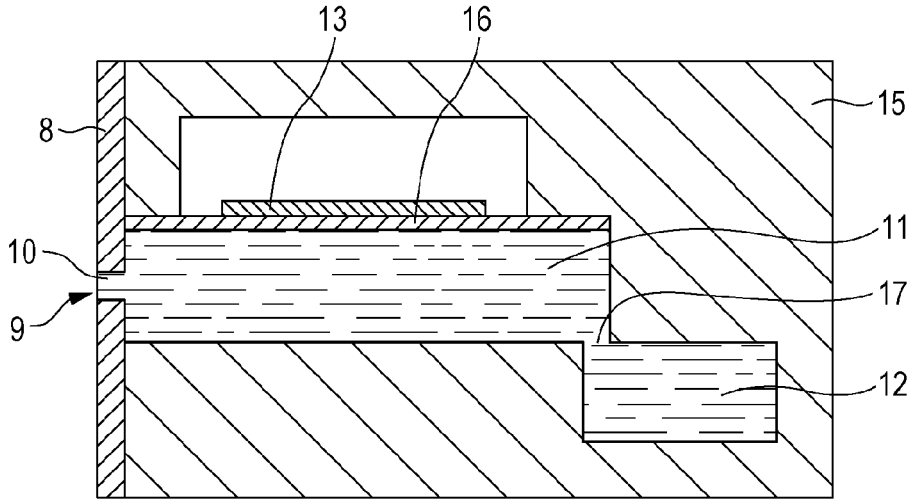
FIG. 2B is a schematic diagram of the liquid ejection head illustrated in FIG. 1.
Figure 2C:
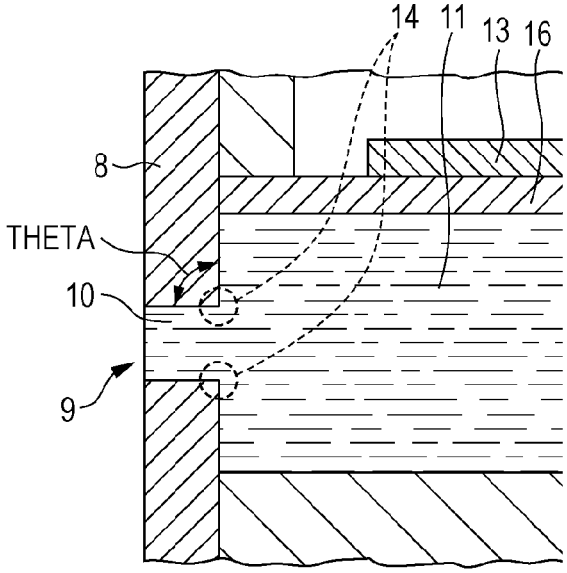
FIG. 2C is a schematic diagram of the liquid ejection head illustrated in FIG. 1.

FIGS. 2A to 2C are schematic diagrams illustrating part of the liquid ejection head 2 according to the first embodiment. FIG. 2A illustrates a bottom surface of one liquid ejection head 2 that faces a recordable medium 3 (see FIG. 1). FIG. 2B is a sectional view of the liquid ejection head 2 taken along a line IIB-IIB of FIG. 2A. FIG. 2C is an enlarged diagram of a portion near an orifice 9 illustrated in FIG. 2B, which will be described below.

The liquid ejection head 2 includes an orifice plate 8 in which first flow paths 10 are formed and a flow-path forming member 15 in which second flow paths 11 and a common liquid chamber 12 are formed. The orifice plate 8 is bonded to the flow-path forming member 15 such that each first flow path 10 communicates with a corresponding second flow path 11. Each orifice 9 is provided with a first flow path 10 and a corresponding second flow path 11. The common liquid chamber 12 is shared by a row of the orifices 9 illustrated in FIG. 2A.

An end of each first flow path 10 that is opposite the second flow path 11 is an orifice 9 through which droplets are ejected. The first flow path 10 has the same diameter as the orifice 9 and is formed perpendicularly to a surface of the orifice plate 8. Thus, the droplets that pass through the first flow path 10 and are ejected from the orifice 9 travel in a direction that is perpendicular to the orifice plate 8.

A droplet ejected from the orifice 9 forms one dot on the recordable medium 3 (see FIG. 1). As the diameter of the orifice 9 and the first flow path 10 decreases, a dot formed on the recordable medium 3 by a droplet ejected from the orifice 9 becomes smaller. The smaller a droplet ejected on the recordable medium 3, the finer the image recorded on the recordable medium 3 by the liquid ejection head 2. Therefore, it is preferable that the orifice 9 and the first flow path 10 have a small diameter. Specifically, it is preferable that the orifice 9 have a diameter of approximately 10 to 20 micrometers so that fine droplets of approximately 1 to 4 pl are ejected from the orifice 9.

The first flow path 10 determines a direction in which droplets are ejected from the orifice 9 with respect to the recordable medium 3. It is thus preferable that the diameter of the first flow path 10 be small so that a liquid flows in one direction to the orifice 9.

In the first embodiment, the diameter of the orifice 9 is 17 micrometers, and the diameter of the first flow path 10 is also 17 micrometers. The thickness of the orifice plate 8 is 17 micrometers. In short, the first flow path 10 has a columnar shape having a diameter of 17 micrometers and a length of 17 micrometers.

The cross-sectional area of the second flow path 11 (an area of a cross section taken in a direction that is perpendicular to the orifice plate 8) is larger than the cross-sectional area of the first flow path 10. Thus, bent-shaped connecting portions 14 are formed between the first flow path 10 and the second flow path 11. In this embodiment, an angle theta of each connecting portion 14 that is formed by a first flow path 10 side end surface of the second flow path 11 (a surface of the orifice plate 8 facing the second flow path 11) and an inner wall surface of the first flow path 10 is 90 degrees (referred to as the "angle theta of the connecting portion 14", below).

A flexible member 16 is disposed on a side surface of each second flow path 11, and a piezoelectric element 13 is disposed on the flexible member 16 on a side that is opposite the second flow path 11. One piezoelectric element 13 is provided for each second flow path 11 that is provided for a corresponding orifice 9.

The liquid ejection apparatus 1 (see FIG. 1) includes a controller (not illustrated) that controls the liquid ejection head 2. The controller applies a voltage having a predetermined waveform to each piezoelectric element 13 in a cycle in which a liquid can be ejected, to control the liquid ejection head 2. The controller of the liquid ejection apparatus 1 that is connected to each piezoelectric element 13 includes electrode wiring (not illustrated) through which a voltage is applied to each piezoelectric element 13.

When a voltage is applied to a piezoelectric element 13, the piezoelectric element 13 bends together with the flexible member 16 toward the second flow path 11 or to a side that is opposite the second flow path 11. When the piezoelectric element 13 and the flexible member 16 bend toward the second flow path 11, the capacity of the second flow path 11 decreases. When the piezoelectric element 13 and the flexible member 16 bend to a side that is opposite the second flow path 11, the capacity of the second flow path 11 is increased. In the liquid ejection head 2 according to this embodiment, a liquid contained in the second flow path 11 is ejected through the first flow path 10 from the orifice 9 by bending the piezoelectric element 13 and the flexible member 16 toward the second flow path 11 and thus reducing the capacity of the second flow path 11.

The length of the second flow path 11 in a direction that is perpendicular to the surface of the orifice plate 8 is 8800 micrometers. The second flow path 11 is a rectangular parallelepiped, has a width (dimension in the depth direction in FIGS. 2B and 2C) of 100 micrometers, and has a height (dimension in the up-and-down directions in FIGS. 2B and 2C) of 200 micrometers.

A common liquid chamber 12 communicates with an end portion of the second flow path 11 that is opposite the first flow path 10. The second flow path 11 and the common liquid chamber 12 are connected to each other via a constricted portion 17. The width (dimension in the right-and-left directions in FIGS. 2B and 2C) of the constricted portion 17 is 50 micrometers.

In this embodiment, a clear ink is used as a liquid that is ejected from the orifice 9. The clear ink is made up of 66% ethylene glycol (EG) 600, 33% pure water, and 1% surfactant. This clear ink has a viscosity of $40*10^{-3}$ pascal-seconds and a surface tension of $38*10^{-3}$ N/m at room temperature.

Figure 3A:
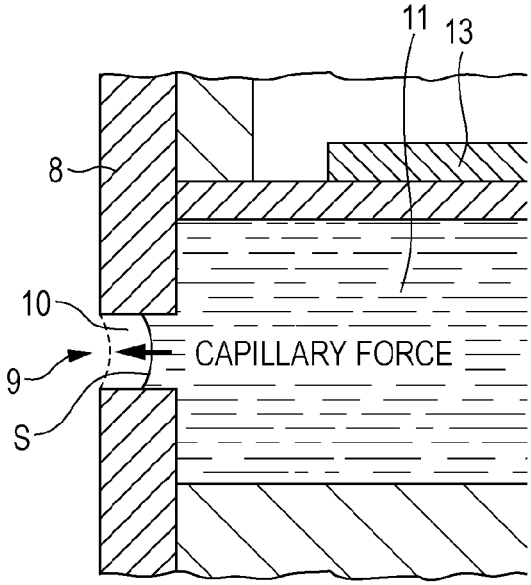
FIG. 3A is a schematic diagram of the liquid ejection head illustrated in FIGS. 2A to 2C.
Figure 3B:
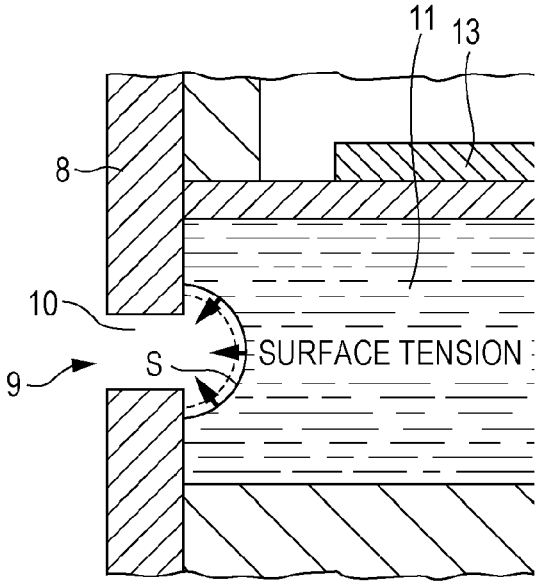
FIG. 3B is a schematic diagram of the liquid ejection head illustrated in FIGS. 2A to 2C.

FIGS. 3A and 3B are sectional views of the liquid ejection head 2. FIG. 3A illustrates a method of driving a liquid ejection head 2 according to a comparative example. FIG. 3B illustrates a method of driving the liquid ejection head 2 according to the embodiment.

The broken lines illustrated in FIGS. 3A and 3B indicate positions of gas-liquid interfaces S, each being an interface between an air and the liquid, before the liquid ejection heads 2 eject the liquid. In FIG. 3A, the liquid is inside the first flow path 10, the gas-liquid interface S before the liquid is ejected is positioned in the first flow path 10, and the liquid forms a concave meniscus such that the liquid in a center portion of the orifice 9 is recessed. In FIG. 3B, the liquid is not inside the first flow path 10 but is in the second flow path 10, and forms a concave meniscus such that the liquid is recessed from the orifice 9 toward the inside of the second flow path 11.

The solid lines adjacent to the broken lines in FIGS. 3A and 3B indicate positions of the gas-liquid interfaces S after the liquid ejection heads 2 have ejected the liquids and before the liquid ejection heads 2 have been refilled with the liquids. After the liquid ejection heads 2 are refilled with the liquids from the states indicated in FIGS. 3A and 3B, the gas-liquid interfaces S return to the positions indicated by the broken lines from the positions indicated by the solid lines.

In the state illustrated in FIG. 3A, the gas-liquid interface S before the liquid is ejected is positioned in the first flow path 10, and thus the liquid has to flow into the first flow path 10 to refill the first flow path 10. As described above, however, the first flow path 10 is formed thin and thus the flow resistance of the first flow path 10 is high for a liquid flowing through the first flow path 10. For this reason, it is difficult to quickly refill the first flow path 10 with the liquid flowing from the second flow path 11.

On the other hand, in the liquid ejection head 2 illustrated in FIG. 3B, the gas-liquid interface S before the liquid is ejected is positioned in the second flow path 11. Thus, it is not the first flow path 10 but the second flow path 11 that is refilled with the liquid. Since the second flow path 11 has a diameter that is far larger than that of the first flow path 10, the flow resistance of the second flow path 11 is low for the liquid flowing through the second flow path 11. Thus, the second flow path 11 can be quickly refilled with the liquid flowing from the common liquid chamber 12 (see FIG. 2B).

In the first flow path 10, the liquid is moved by capillary force in a direction indicated by the arrow illustrated in FIG. 3A. In the second flow path 11 on the other hand, the liquid is affected by a surface tension and thus moves in a direction indicated by the arrows illustrated in FIG. 3B. Since the surface area of the gas-liquid interface S that is in the state as illustrated in FIG. 3B is large, the surface tension that causes the gas-liquid interface S to return toward the orifice 9 is large. For this reason, the effect of the surface tension illustrated in FIG. 3B is larger than the effect of the capillary force illustrated in FIG. 3A. From this viewpoint as well, the liquid flows faster through the second flow path 11 than through the first flow path 10 during a refilling operation.

In this embodiment, as illustrated in FIG. 3B, the piezoelectric element 13 is driven while the gas-liquid interface S is receding in the second flow path 11 (while the gas-liquid interface S is positioned at the broken line). Thus, when the piezoelectric element 13 is deformed and the second flow path 11 is contracted, part of the liquid contained in the contracted second flow path 11 is instantaneously ejected through the first flow path 10 from the orifice 9. Then, at the timing when the liquid projects from the orifice 9, the piezoelectric element 13 is driven such that the gas-liquid interface S recedes into the second flow path 11. Accordingly, in this embodiment, the gas-liquid interface S recedes back into the second flow path 11 immediately after a droplet is ejected from the orifice 9.

With the method of driving the liquid ejection head 2 according to the embodiment, only the second flow path 11 needs to be refilled with the liquid flowing from the common liquid chamber 12 and there is no need to refill the first flow path 10 with the liquid flowing from the second flow path 11. For the reason described above, the liquid ejection head 2 can be quickly refilled with the liquid with the method of driving the liquid ejection head 2 according to the embodiment. Thus, the liquid ejection head 2 can be sufficiently refilled with the liquid even in the case where the liquid ejection head 2 is driven at a high frequency and ejects a large number of droplets per unit time.

Figure 4:
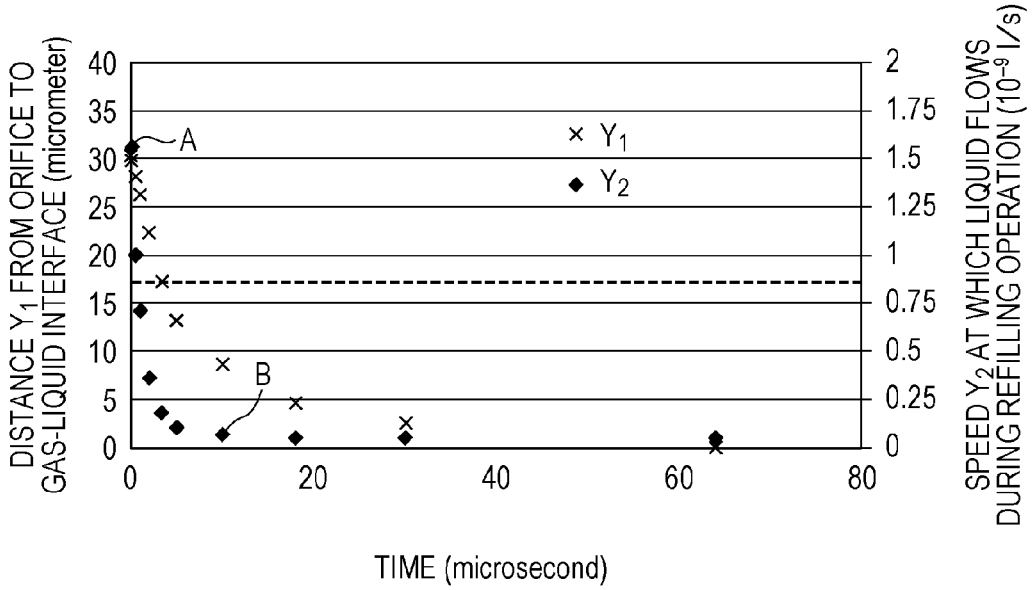
FIG. 4 is a graph indicating data of experiments conducted by using the liquid ejection head according to the first embodiment.

FIG. 4 is a graph indicating results of experiments conducted by using the liquid ejection head according to the first embodiment. In the experiments, an initial position of the gas-liquid interface S was set to be approximately 30.3 micrometers away from the orifice 9, and the liquid ejection head was refilled with the liquid without the voltage being applied to the piezoelectric element 13 from a state in which the gas-liquid interface S was at the initial position. The axis of abscissas represents time. A first axis of ordinates (left axis of ordinates) represents a distance $Y_1$ from the orifice 9 to the gas-liquid interface S. Values for the distance $Y_1$ with respect to the time are plotted with cross marks. A second axis of ordinates (right axis of ordinates) represents the speed $Y_2$ at which the liquid flows during a refilling operation. Values for the speed $Y_2$ with respect to the time are plotted with filled symbols.

As is clear from FIG. 4, the speed $Y_2$ at which the liquid flows during a refilling operation (given as the refilling speed $Y_2$ below) sharply drops and then becomes constant with time. The reason for this will be described separately for the case where the gas-liquid interface S is positioned in the second flow path 11 and for the case where the gas-liquid interface S is positioned in the first flow path 10. Here, the thickness of the orifice plate 8 is 17 micrometers. Thus, a position that is 17 mlcrometers away from the orifice 9 (position at the broken line illustrated in FIG. 4) is a position of a boundary between the first flow path 10 and the second flow path 11.

Firstly, in the case where the gas-liquid interface S is positioned in the second flow path 11, the area of the gas-liquid interface S decreases further as the amount of liquid injected in the refilling operation increases. When the area of the gas-liquid interface S decreases, the effect of the surface tension, which acts as the motive force for moving the liquid, decreases. Thus, the refilling speed $Y_2$ drops until the liquid proceeds to a position that is 17 micrometers away from the orifice 9. On the other hand, in the case where the gas-liquid interface S is positioned in the first flow path 10, the effect of the capillary force acting on the liquid contained in the first flow path 10 does not markedly change even when the amount of liquid injected in the refilling operation increases. For this reason, the refilling speed $Y_2$ is almost uniformly low when the gas-liquid interface S is positioned to be 17 micrometers or less away from the orifice 9.

When the refilling speed $Y_2$ at the time point when the gas-liquid interface S has the largest area (plot A in FIG. 4) is compared with the speed $Y_1$ for the time after the gas-liquid interface S enters the first flow path 10 (plot B in FIG. 4), it is found that the refilling speed $Y_2$ is several tens of times higher than the speed $Y_1$.

For these reasons, it is found that the refilling speed $Y_2$ markedly increases by maintaining the gas-liquid interface S to be in a receding state in the second flow path 11 as illustrated in FIG. 3B.

Figure 5:
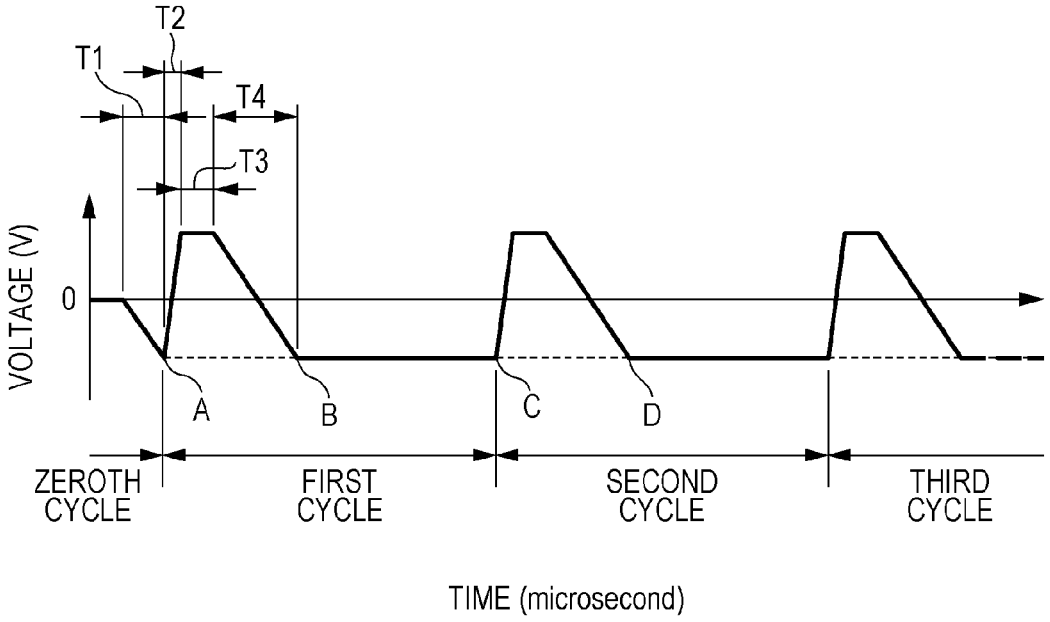
FIG. 5 illustrates a waveform of a voltage applied to a piezoelectric element of the liquid ejection head according to the first embodiment.

FIG. 5 is a graph indicating a waveform of a voltage applied to the piezoelectric element 13 according to the embodiment. FIGS. 6A to 6L illustrate the behavior of the liquid contained in the liquid ejection head 2 that is driven by the method of driving the liquid ejection head 2 according to the embodiment.

While FIG. 5 is referred to, the method according to the embodiment will be described in detail in order from FIGS. 6A to 6L.

In FIG. 5, periods during each of which one droplet can be ejected from the orifice 9 by driving the piezoelectric element 13 of the liquid ejection head 2 according to the embodiment will be sequentially referred to as a first cycle, a second cycle, and a third cycle in this order. Here, in this method according to the embodiment, a zeroth cycle is provided prior to the first cycle in which a droplet is ejected for the sake of explanatory convenience.

Figure 6A:
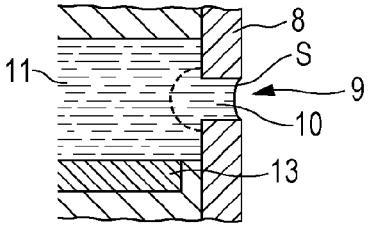
FIG. 6A illustrates an operational state of the liquid ejection head according to the first embodiment.

FIG. 6A illustrates a state of the liquid ejection head 2 before the liquid ejection head 2 according to the embodiment is driven (initial state). In this state, both the first flow path 10 and the second flow path 11 are filled with the liquid and the gas-liquid interface S is positioned at a static position near the orifice 9. The liquid ejection head 2 is in an initial state when the time on the axis of abscissas in the zeroth cycle in FIG. 5 is 0 microseconds.

Firstly, an operation of ejecting a droplet in the first cycle illustrated in FIG. 5 will be described. The first cycle is a primary cycle in which a droplet is ejected.

Figure 6B:
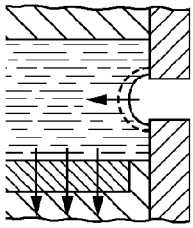
FIG. 6B illustrates an operational state of the liquid ejection head according to the first embodiment.

During a period T1 illustrated in FIG. 5 in the zeroth cycle that is prior to the first cycle in which a droplet is ejected, a negative voltage is applied to the piezoelectric element 13 to move the gas-liquid interface S from the initial state to a position indicated by the broken line illustrated in FIG. 6A. Consequently, at the time point A illustrated in FIG. 5 at which the first cycle starts, as illustrated in FIG. 6B, the piezoelectric element 13 to which the negative voltage (first voltage) has been applied bends in a concave shape, the second flow path 11 expands, and the gas-liquid interface S moves to the position indicated by the broken line illustrated in FIGS. 6A and 6B. Here, the liquid forms a concave meniscus inside the second flow path 11 (first stage).

Figure 6C:
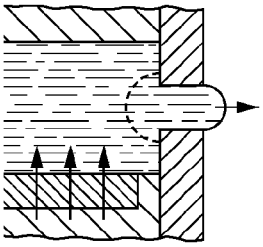
FIG. 6C illustrates an operational state of the liquid ejection head according to the first embodiment.

Subsequently, in a period T2 illustrated in FIG. 5, a positive voltage is applied to the piezoelectric element 13 to move the gas-liquid interface S to a position indicated by the solid line in FIG. 6C. Consequently, the piezoelectric element 13 to which the positive voltage (second voltage) has been applied bends in a convex shape, the second flow path 11 contracts, and the liquid flows into the first flow path 10. Then, in a period T3 illustrated in FIG. 5, the positive voltage that has been applied to the piezoelectric element 13 is maintained until the gas-liquid interface S moves to the position indicated by the solid line in FIG. 6C. As a result, the liquid protrudes from the orifice 9 and forms a convex meniscus as illustrated in FIG. 6C (second stage).

Figure 6D:
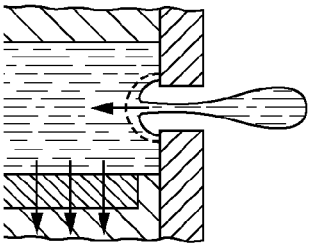
FIG. 6D illustrates an operational state of the liquid ejection head according to the first embodiment.
Figure 6E:
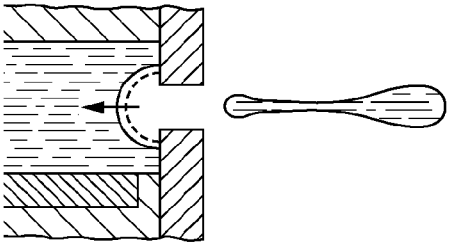
FIG. 6E illustrates an operational state of the liquid ejection head according to the first embodiment.

In a period T4 illustrated in FIG. 5, a negative voltage is applied to the piezoelectric element 13 to return the gas-liquid interface S to a position indicated by the broken line in FIG. 6D at the timing when the liquid protrudes from the orifice 9. With the application of the negative voltage, the piezoelectric element 13 bends in a concave shape and the liquid contained in the first flow path 10 recedes into the second flow path 11. On the other hand, part of the liquid that protrudes from the orifice 9 as illustrated in FIG. 6C in the period T3 illustrated in FIG. 5 is ejected from the orifice 9 by the inertial force without receding into the second flow path 11. At this time, a tail of the liquid is generated between the part of the liquid receding into the second flow path 11 and the part of the liquid ejected from the orifice 9. At the time point B illustrated in FIG. 5, a negative voltage, which is equal to the negative voltage (first voltage) applied at the time point A, is applied to the piezoelectric element 13. At the same time, the tail of the liquid breaks and a first droplet is ejected as illustrated in FIG. 6E (third stage).

Figure 6F:
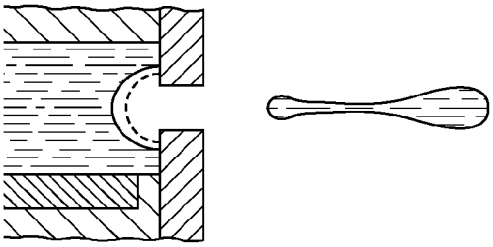
FIG. 6F illustrates an operational state of the liquid ejection head according to the first embodiment.
Figure 6G:
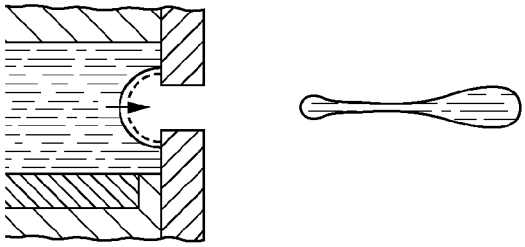
FIG. 6G illustrates an operational state of the liquid ejection head according to the first embodiment.

At the time point B, as indicated by the solid line in FIG. 6F, the gas-liquid interface S is positioned so as to be retracted from the first flow path 10 beyond the position indicated by the broken line as in FIG. 6A. This is because the amount of the liquid in the second flow path 10 is reduced by ejecting the droplet.

Figure 6H:
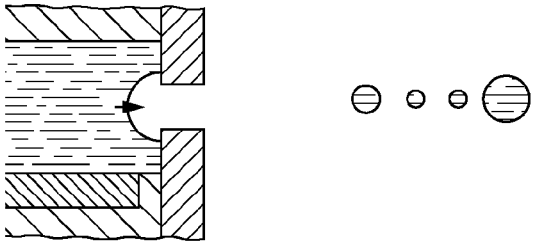
FIG. 6H illustrates an operational state of the liquid ejection head according to the first embodiment.
Figure 6I:
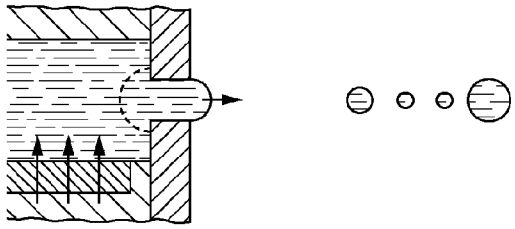
FIG. 6I illustrates an operational state of the liquid ejection head according to the first embodiment.
Figure 6J:
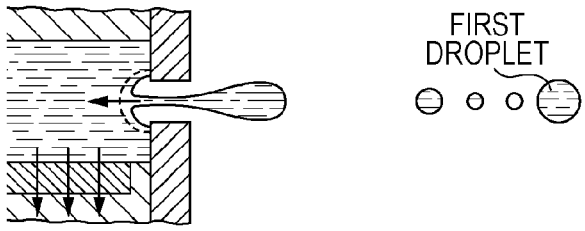
FIG. 6J illustrates an operational state of the liquid ejection head according to the first embodiment.
Figure 6K:
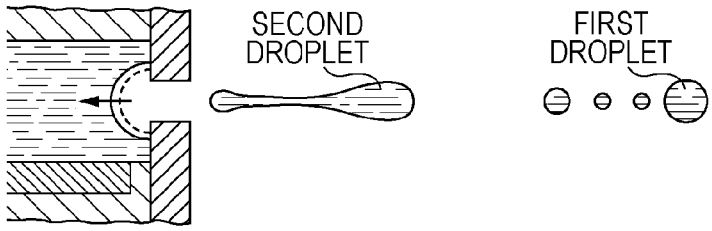
FIG. 6K illustrates an operational state of the liquid ejection head according to the first embodiment.
Figure 6L:
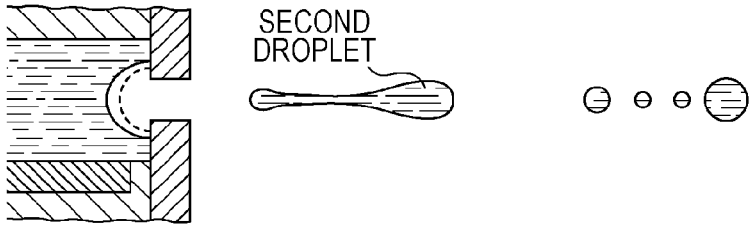
FIG. 6L illustrates an operational state of the liquid ejection head according to the first embodiment.

The negative voltage that has been applied to the piezoelectric element 13 at the time point B is maintained until the time point C illustrated in FIG. 5. With this application of the negative voltage, the second flow path 11 is refilled with the liquid flowing from the common liquid chamber 12 (see FIG. 2). Thus, the gas-liquid interface S moves to a position indicated by the broken line in FIG. 6G between the time points B and C. At the time point C, as illustrated in FIG. 6H, the gas-liquid interface S returns to the position indicated by the broken line in FIGS. 6A and 6B. Here, the gas-liquid interface S is in the same state as at the time point A. In other words, at the time point C at which the second cycle starts, the liquid ejection head 2 returns to the above-described first stage in the same way as at the time point A at which the first cycle starts.

Next, an operation of ejecting a droplet in the second cycle illustrated in FIG. 5 will be described. The second cycle is also the primary cycle in which a droplet is ejected.

In this embodiment, a droplet is ejected also in the second cycle, and thus a voltage having a waveform that is similar to the one applied in the first cycle illustrated in FIG. 5 is applied to the piezoelectric element 13. Consequently, the behavior of the liquid in the second cycle illustrated in FIGS. 6I to 6L is similar to the behavior of the liquid in the first cycle illustrated in FIGS. 6C to 6F. Specifically, a meniscus moves toward the orifice 9 with the refilling operation illustrated in FIG. 6H. Here, before the meniscus enters the first flow path 10, a positive voltage is applied to the piezoelectric element 13. As in the first cycle, after a period in which the positive voltage is maintained, a negative voltage is applied to the piezoelectric element 13 until the time point D. Thus, a second droplet is ejected. In FIG. 5, the time points A and B in the first cycle correspond to the time points C and D in the second cycle.

In the third or subsequent cycle, a voltage having a waveform that is similar to that in the first and second cycles is applied to the piezoelectric element 13 and thus a third or subsequent droplet is ejected. In this manner, droplets can be ejected a desired number of times.

Here, a case is assumed where no negative voltage is applied to the piezoelectric element 13 in the zeroth cycle in which the liquid ejection head is in the initial state and then, a positive voltage is applied to the piezoelectric element 13 in the first cycle so that a droplet is ejected from the orifice 9. In this case, the amount of a first droplet is larger than the amount of a second or subsequent droplet.

For this reason, in this embodiment, a negative voltage (first voltage) is applied to the piezoelectric element 13 from the zeroth cycle in which the liquid ejection head is in the initial state illustrated in FIG. 5 until the start of the first cycle in which a droplet is ejected, and thus the gas-liquid interface S is positioned in the second flow path 11. With this operation, the amount of the first droplet that is ejected from the orifice 9 becomes substantially equal to the amount of the second or subsequent droplet.

Figure 7A:
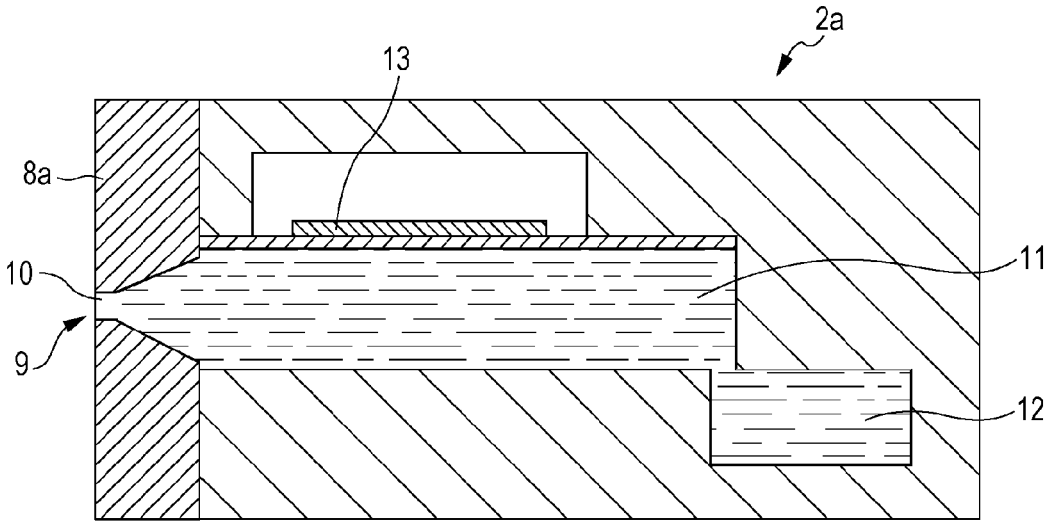
FIG. 7A is a schematic diagram of a liquid ejection head according to a modification obtained by modifying the liquid ejection head illustrated in FIGS. 2A to 2C.
Figure 7B:
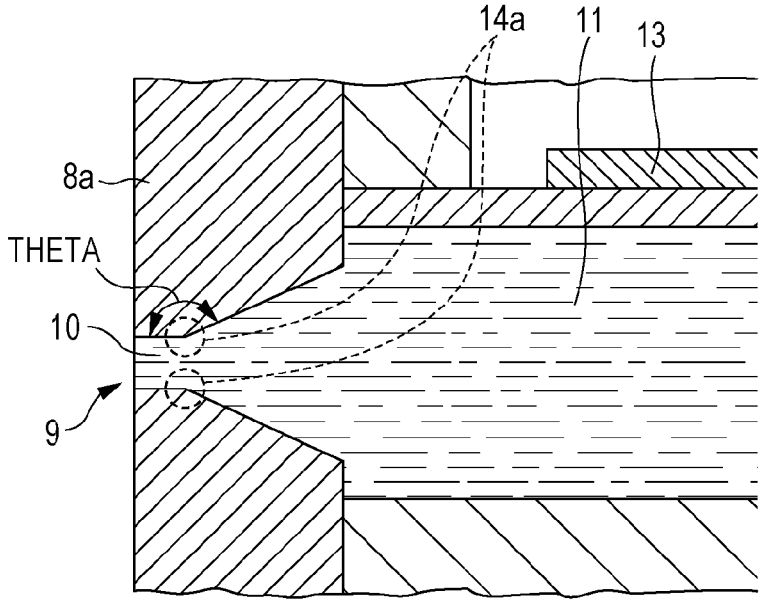
FIG. 7B is a schematic diagram of the liquid ejection head according to the modification obtained by modifying the liquid ejection head illustrated in FIGS. 2A to 2C.

FIGS. 7A and 7B are schematic diagrams of a liquid ejection head 2*a* according to a modification. Except for an orifice plate 8*a*, the liquid ejection head 2*a* has a configuration similar to that of the liquid ejection head 2 illustrated in FIGS. 2A to 2C. In FIGS. 7A and 7B, components that are the same as those in FIGS. 2A to 2C are denoted by the same reference signs and the description thereof will not be given.

A side of the orifice plate 8*a* of the liquid ejection head 2*a* that faces the second flow path 11 is tapered such that the thickness of the orifice plate 8*a* decreases with decreasing distance to the first flow path 10. The angle theta of each connecting portion 14 in FIG. 2C is 90 degrees, while the angle theta of connecting portions 14*a* in FIG. 7B is larger than 90 degrees. Specifically, the angle theta of each connecting portion 14*a* is 110 degrees. Also in this case, droplets can be ejected repeatedly by applying a voltage having a waveform that is similar to the one illustrated in FIG. 5 to the piezoelectric element 13.

Figure 8A:
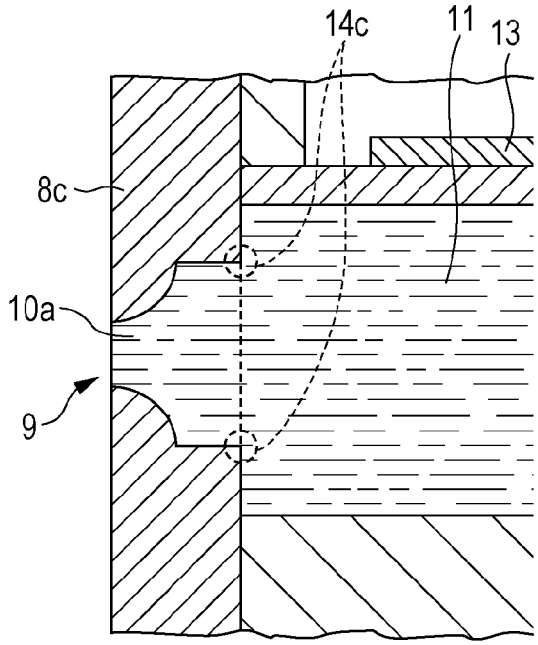
FIG. 8A is a schematic diagram of a liquid ejection head according to another modification obtained by modifying the liquid ejection head illustrated in FIGS. 2A to 2C.
Figure 8B:
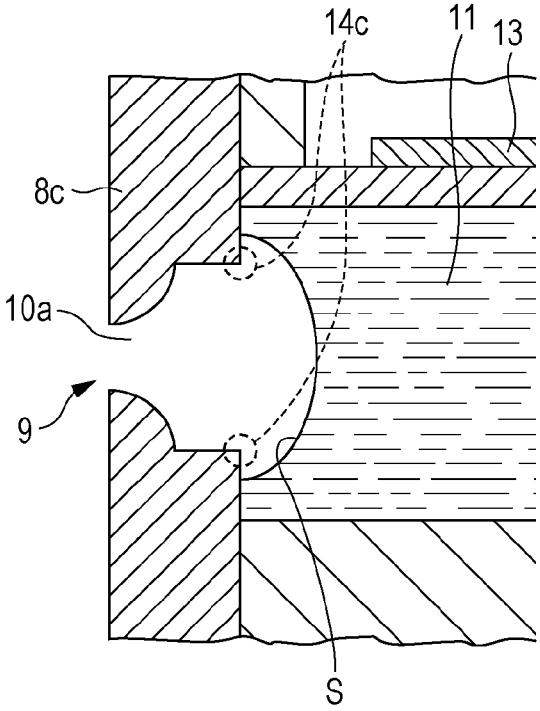
FIG. 8B is a schematic diagram of the liquid ejection head according to the modification obtained by modifying the liquid ejection head illustrated in FIGS. 2A to 2C.

In this embodiment, a liquid ejection head is described that has a first flow path having a columnar shape. However, the method according to the embodiment is also applicable to a liquid ejection head having a first flow path not having a columnar shape. For example, it is confirmed that droplets can be repeatedly ejected through a first flow path having a shape illustrated in FIG. 8A or 8B by applying a voltage having a waveform that is similar to the one illustrated in FIG. 5 to the piezoelectric element 13.

Second Embodiment

A second embodiment of the present invention will be described with reference to the drawings.

In the second embodiment, a liquid ejection head 2 of a liquid ejection apparatus 1 (see FIG. 1) that is similar to the one according to the first embodiment is employed, and a liquid (clear ink) that is similar to the one employed in the first embodiment is used.

Figure 9:
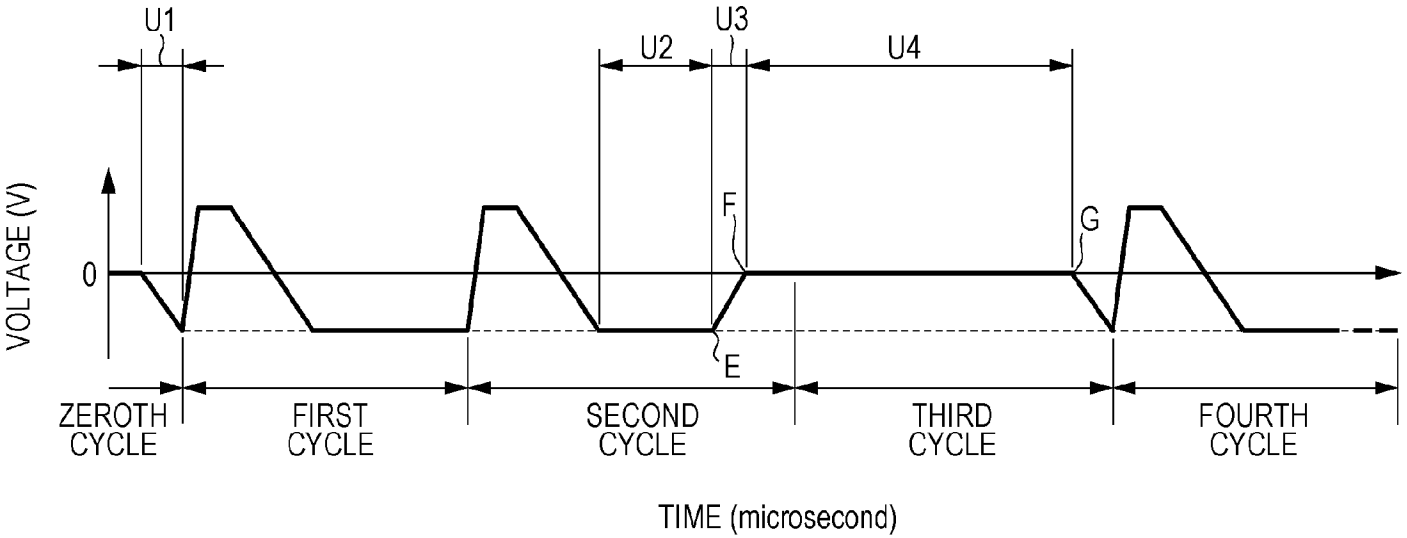
FIG. 9 illustrates a waveform of a voltage applied to a piezoelectric element of the liquid ejection head according to a second embodiment of the present invention.

FIG. 9 is a graph illustrating a waveform of a voltage that is applied to the piezoelectric element 13 in this embodiment. FIGS. 10A to 10L illustrate the behavior of the liquid contained in the liquid ejection head 2 that is driven by the method of driving the liquid ejection head 2 according to the second embodiment.

While FIG. 9 is referred to, the method of driving a liquid ejection head 2 according to the second embodiment will be described in detail in order from FIGS. 10A to 10L.

Figure 10A:
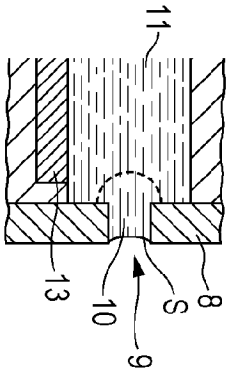
FIG. 10A illustrates an operational state of the liquid ejection head according to the second embodiment.
Figure 10B:
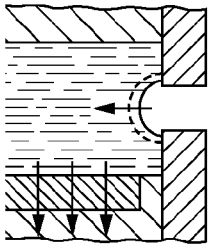
FIG. 10B illustrates an operational state of the liquid ejection head according to the second embodiment.
Figure 10C:
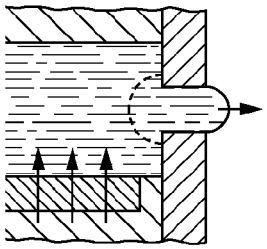
FIG. 10C illustrates an operational state of the liquid ejection head according to the second embodiment.
Figure 10D:
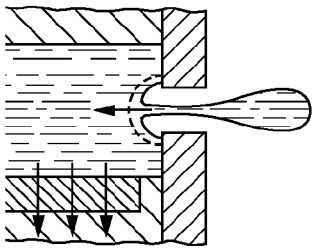
FIG. 10D illustrates an operational state of the liquid ejection head according to the second embodiment.
Figure 10E:
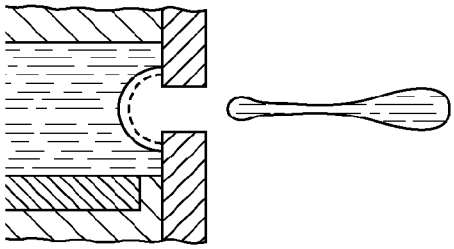
FIG. 10E illustrates an operational state of the liquid ejection head according to the second embodiment.
Figure 10F:
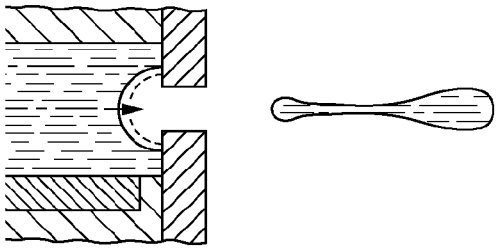
FIG. 10F illustrates an operational state of the liquid ejection head according to the second embodiment.

FIG. 10A illustrates an initial state of the liquid ejection head 2 according to the second embodiment. In this state, both the first flow path 10 and the second flow path 11 are filled with the liquid and thus the gas-liquid interface S is at a static position near the orifice 9.

Figure 10G:
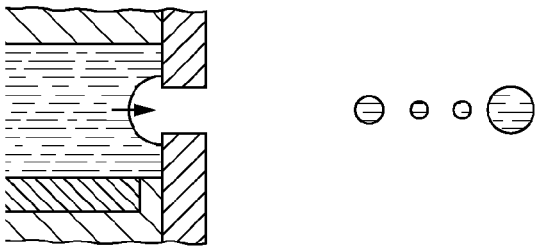
FIG. 10G illustrates an operational state of the liquid ejection head according to the second embodiment.
Figure 10H:
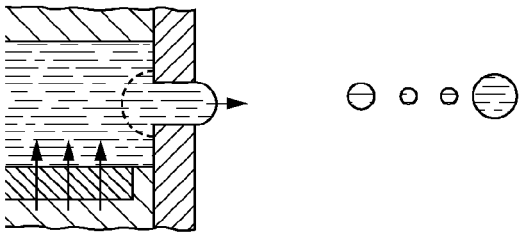
FIG. 10H illustrates an operational state of the liquid ejection head according to the second embodiment.
Figure 10I:
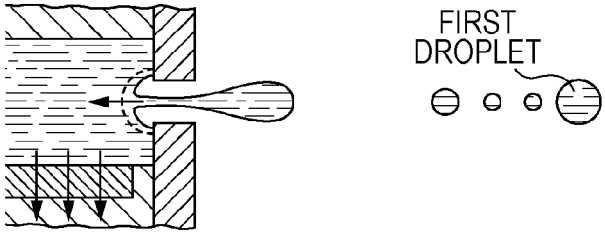
FIG. 10I illustrates an operational state of the liquid ejection head according to the second embodiment.
Figure 10J:
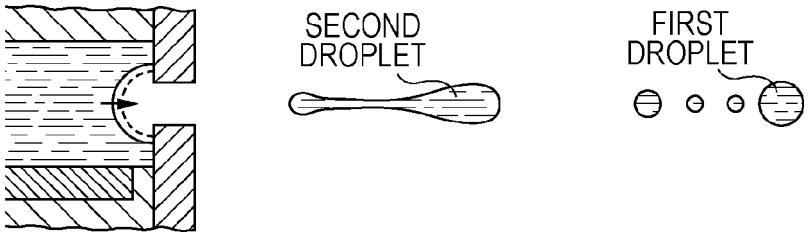
FIG. 10J illustrates an operational state of the liquid ejection head according to the second embodiment.
Figure 10K:
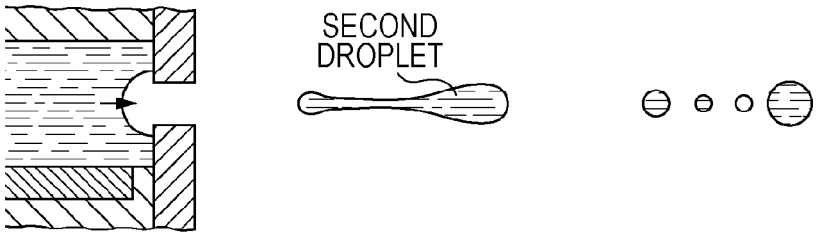
FIG. 10K illustrates an operational state of the liquid ejection head according to the second embodiment.
Figure 10L:
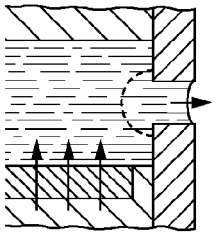
FIG. 10L illustrates an operational state of the liquid ejection head according to the second embodiment.

The waveform in the zeroth and first cycles in FIG. 9 is the same as the one in the zeroth and first cycles in FIG. 5. Thus, the behavior of the liquid in the zeroth and first cycles illustrated in FIGS. 10A to 10F in the liquid ejection head according to the second embodiment is similar to the behavior of the liquid in the zeroth and first cycles illustrated in FIGS. 6A to 6F in the liquid ejection head according to the first embodiment. FIG. 10G illustrates a state that is after the first cycle and in which the gas-liquid interface S has returned to the same position as the gas-liquid interface S is positioned before the liquid ejection head 2 ejects the liquid, the position being indicated by the broken lines in FIGS. 10A to 10L. Then, a second droplet is ejected in the second cycle in the same manner as in the first embodiment (FIGS. 10H to 10K). FIG. 10K illustrates a state that is after a period U2 of the second cycle illustrated in FIG. 9 and in which the gas-liquid interface S has returned to the same position as the gas-liquid interface S is positioned before the liquid ejection head 2 ejects the liquid, the position being indicated by the broken lines in FIGS. 10A to 10L.

The third cycle following the second cycle is a secondary cycle in which a droplet is not ejected. Here, the voltage to be applied to the piezoelectric element 13 is changed to zero during a period U3 following the period U2 of the second cycle. Consequently, the second flow path 11 is contracted such that the second flow path 11 is in a state before continuous ejection is started, and the gas-liquid interface S is moved toward the orifice 9, which is a stationary position (See FIG. 10L). While the continuous ejection is temporarily stopped (for example, during the third cycle in the example illustrated in FIG. 9), the gas-liquid interface S has to successfully return to the orifice 9, which is a stationary position. This is because, if next ejection starts before the gas-liquid interface S returns to the stationary position, the initial state of the gas-liquid interface S becomes different from that in the case where the gas-liquid interface S is in the stationary position. Accordingly, different ejection results will be obtained even when the liquid ejection head 2 is driven in the same manner. For this reason, by the time immediately before the timing (indicated by G in FIG. 9) when the second flow path is expanded for starting ejection in a next cycle, the gas-liquid interface S has to return to the stationary position. However, as described above, since it takes long time to refill the first flow path 10, it is difficult to return the gas-liquid interface S to the stationary position by the start of next ejection by waiting the first flow path 10 to be naturally refilled with the liquid. On the other hand, in this embodiment, by returning the piezoelectric element 13 to the initial state, the second flow path 11 is contracted and thus the gas-liquid interface S is forcibly pushed toward the orifice 9 with a flow of the liquid generated by the contraction. Thus, the gas-liquid interface S is capable of quickly returning to the stationary position.

In this embodiment, the liquid ejection head is maintained to be in the initial state in a period U4, part of which is included in the second cycle and the other part is included in the third cycle in which a droplet is not ejected, by applying no voltage to the piezoelectric element 13. Thus, a droplet is not ejected in the third cycle.

A fourth cycle following the third cycle is the primary cycle in which a droplet is ejected. Here, the fourth cycle starts while the gas-liquid interface S is positioned in the second flow path 11. Thus, in the same manner as in the zeroth cycle, a negative voltage is started to be applied to the piezoelectric element 13 at a time point G in the third cycle. With this application of the negative voltage, a droplet can be ejected in the fourth cycle in the same manner as in the first cycle.

Figure 11:
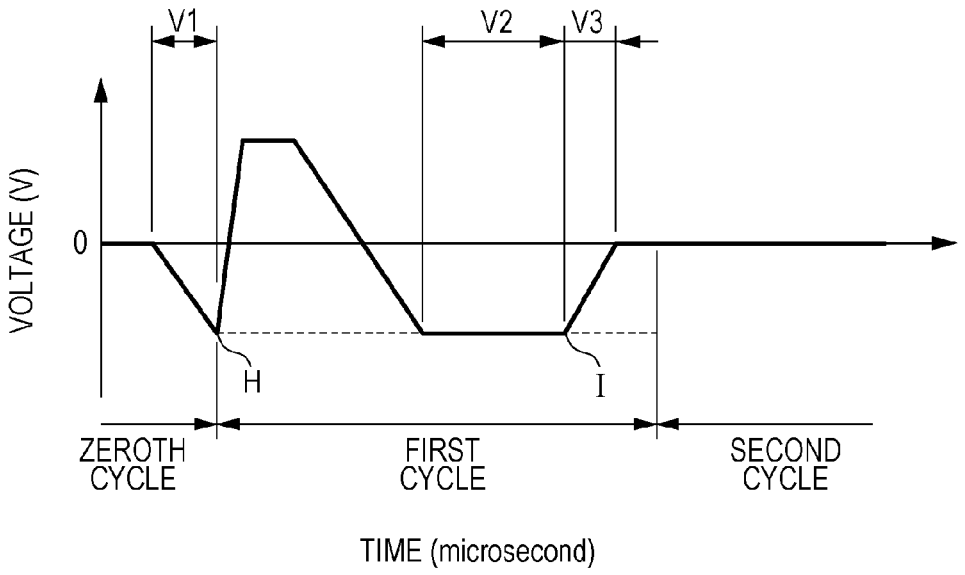
FIG. 11 illustrates a waveform of a voltage applied to a piezoelectric element of a liquid ejection head according to a modification obtained by modifying the piezoelectric element of the liquid ejection head according to the second embodiment.

FIG. 11 is a graph illustrating a waveform of a voltage that is applied to the piezoelectric element 13 in the case where a droplet is ejected in the first cycle and a droplet is not ejected in the second cycle. The waveform in the zeroth, first, and second cycles in FIG. 11 is the same as the waveform in the zeroth, second, and third cycles in FIG. 9. Thus, a droplet is ejected in the first cycle in FIG. 11 but a droplet is not ejected in the second cycle.

As described above, as in the embodiment, even in the case where the secondary cycle in which a droplet is not ejected exists, droplets can be repeatedly ejected favorably by bringing the liquid ejection head 2 into the initial state in the secondary cycle in which a droplet is not ejected.

In the case where secondary cycles in each of which a droplet is not ejected continue, the liquid ejection head 2 is kept in the initial state until the last one of the secondary cycles immediately before a primary cycle in which a droplet is ejected.

With the method of driving a liquid ejection head 2 according to this embodiment, the liquid ejection head 2 can favorably perform ejecting operations even when the primary cycle in which a droplet is ejected and the secondary cycle in which a droplet is not ejected coexist. Even when primary cycles in each of which a droplet is ejected continue, the liquid flows at a high speed in a refilling operation because the liquid is injected into the second flow path 11, not into the first flow path 10 that is formed thin. Thus, the liquid ejection head 2 can be driven at a high frequency.

Third Embodiment

A third embodiment of the present invention will be described with reference to the drawings.

In a method of driving a liquid ejection head according to the third embodiment, a liquid (clear ink) that is similar to the one employed in the first embodiment is used.

Figure 12A:
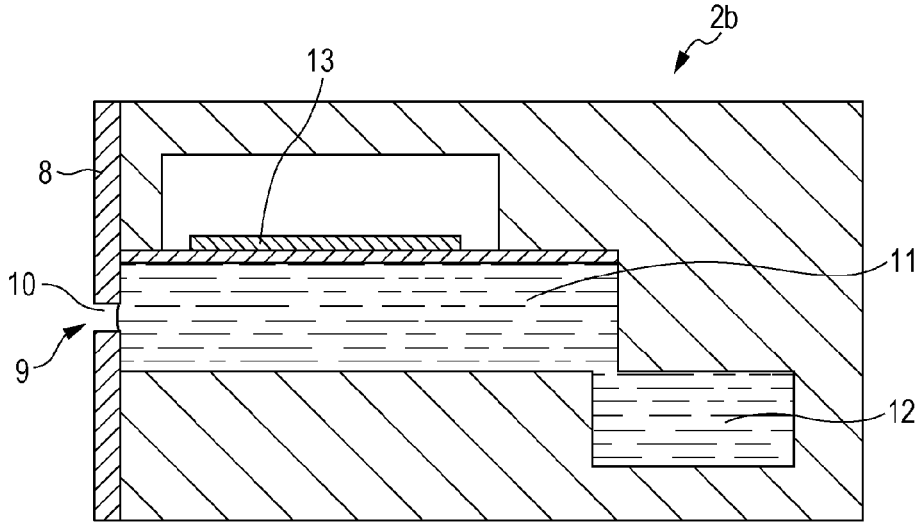
FIG. 12A is a schematic diagram of a liquid ejection head according to a third embodiment of the present invention.
Figure 12B:
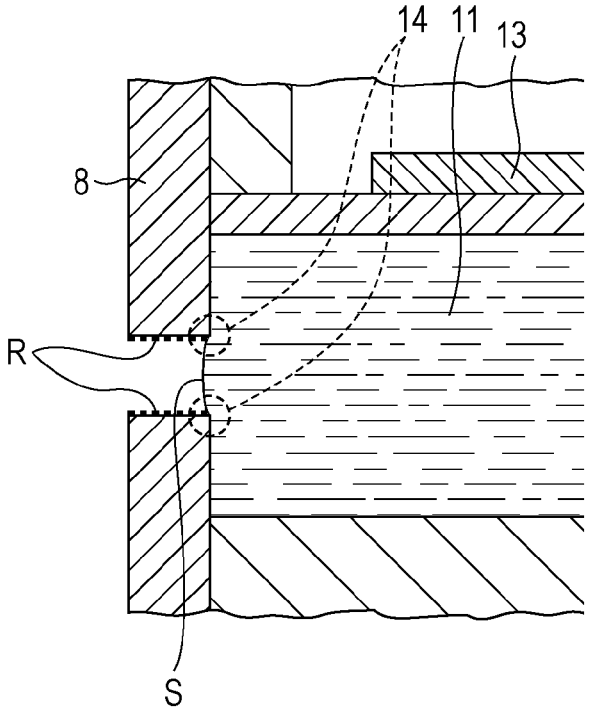
FIG. 12B is a schematic diagram of the liquid ejection head according to the third embodiment of the present invention.

FIGS. 12A and 12B are schematic diagrams of a liquid ejection head 2*b* according to the third embodiment of the present invention. FIGS. 12A and 12B are sectional views corresponding to those of FIGS. 2B and 2C.

An inner wall surface of a first flow path 10 of the liquid ejection head 2*b* is subjected to a liquid-repelling treatment. With this treatment, a static position of the gas-liquid interface S for the case where the liquid ejection head 2*b* is in the initial state, which is the state before ejecting a droplet, is maintained near the border between the first flow path 10 and the second flow path 11.

Figure 13:
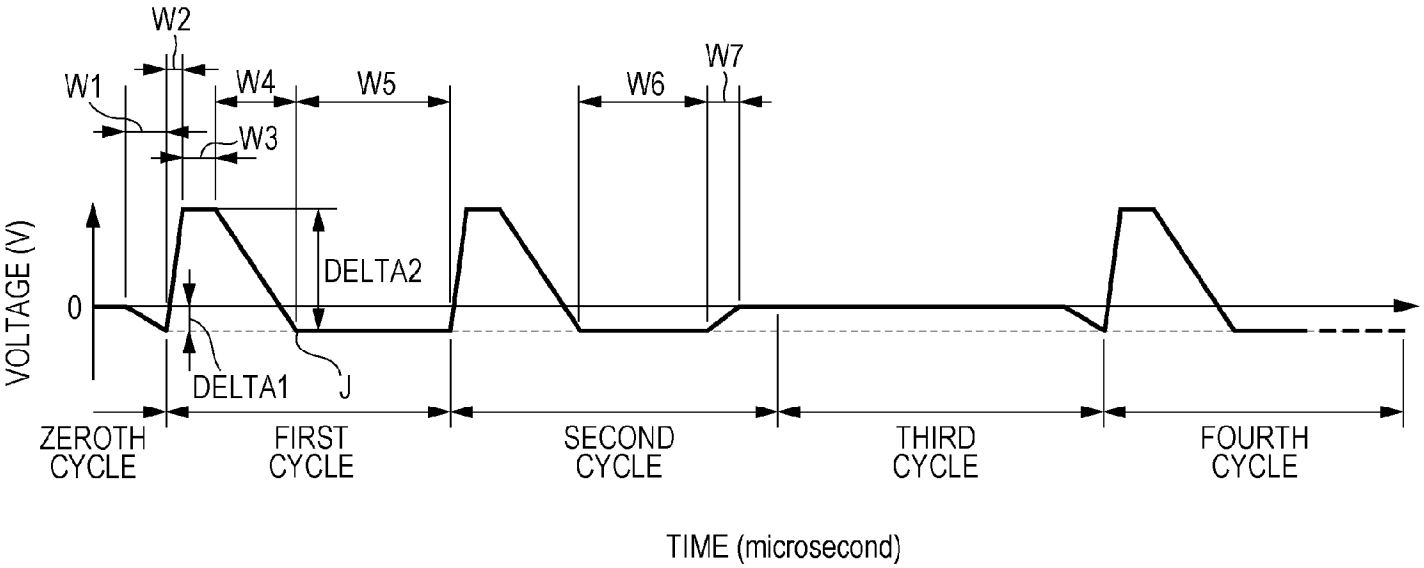
FIG. 13 illustrates a waveform of a voltage applied to a piezoelectric element of the liquid ejection head according to the third embodiment.

FIG. 13 is a graph of a waveform of a voltage applied to a piezoelectric element 13 according to the third embodiment. FIGS. 14A to 14L illustrate the behavior of the liquid contained in the liquid ejection head 2*b* that is driven by the method of driving the liquid ejection head 2*b* according to the third embodiment.

While FIG. 13 is referred to, the method of driving a liquid ejection head 2*b* according to the embodiment will be described in detail in order from FIGS. 14A to 14L.

Figure 14A:
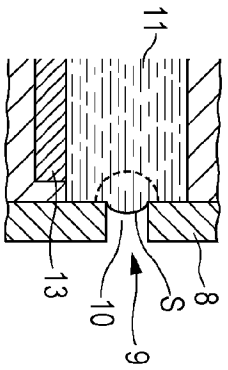
FIG. 14A illustrates an operational state of the liquid ejection head according to the third embodiment.
Figure 14B:
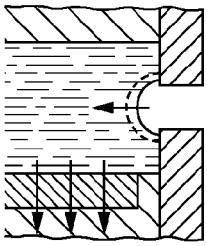
FIG. 14B illustrates an operational state of the liquid ejection head according to the third embodiment.
Figure 14C:
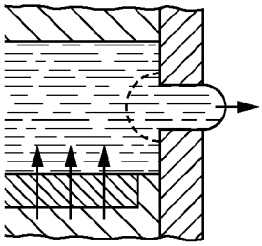
FIG. 14C illustrates an operational state of the liquid ejection head according to the third embodiment.
Figure 14D:
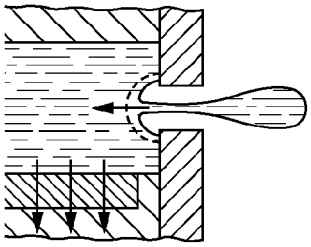
FIG. 14D illustrates an operational state of the liquid ejection head according to the third embodiment.
Figure 14E:
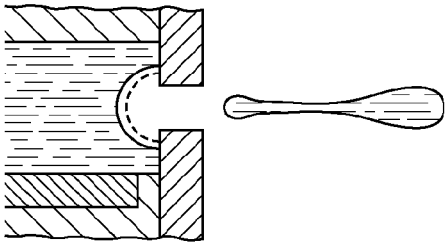
FIG. 14E illustrates an operational state of the liquid ejection head according to the third embodiment.
Figure 14F:
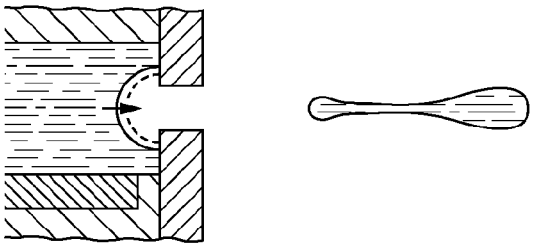
FIG. 14F illustrates an operational state of the liquid ejection head according to the third embodiment.
Figure 14G:
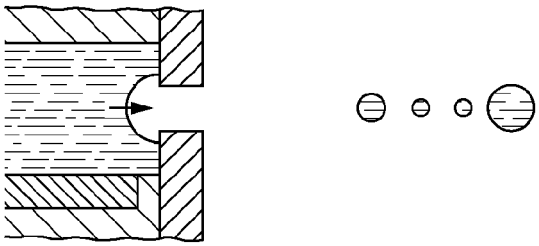
FIG. 14G illustrates an operational state of the liquid ejection head according to the third embodiment.
Figure 14H:
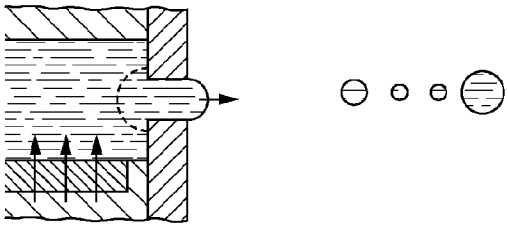
FIG. 14H illustrates an operational state of the liquid ejection head according to the third embodiment.
Figure 14I:
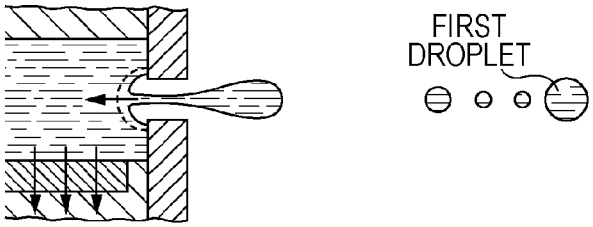
FIG. 14I illustrates an operational state of the liquid ejection head according to the third embodiment.
Figure 14J:
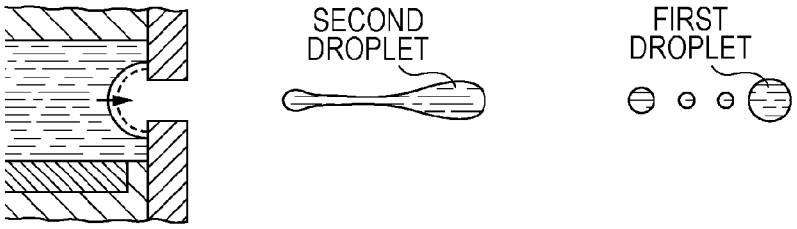
FIG. 14J illustrates an operational state of the liquid ejection head according to the third embodiment.
Figure 14K:
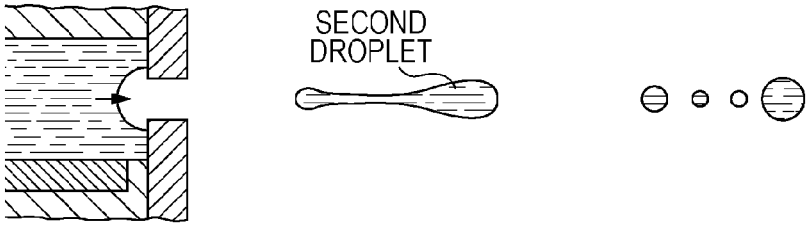
FIG. 14K illustrates an operational state of the liquid ejection head according to the third embodiment.

FIG. 14A illustrates the initial state of the liquid ejection head 2*b* according to the embodiment. In this state, the gas-liquid interface S is positioned at a static position near the border between the first flow path 10 and the second flow path 11. In this embodiment, as in the second embodiment, a droplet is ejected in each of the first and second cycles, a droplet is not ejected in the third cycle, and a droplet is ejected again in the fourth cycle.

Figure 14L:
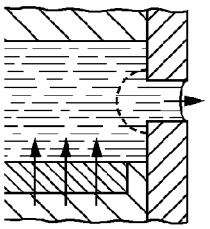
FIG. 14L illustrates an operational state of the liquid ejection head according to the third embodiment.

The behavior of the liquid illustrated in FIGS. 14B to 14K are similar to the behavior of the liquid illustrated in FIGS. 10B to 10K according to the second embodiment. In FIG. 14L, a voltage applied to the piezoelectric element 13 is set to zero and thus the gas-liquid interface S is brought back to the static position near the border between the first flow path 10 and the second flow path 11.

In this embodiment, the duration of a period W1 is 2 microseconds, the duration of a period W2 is 1 microsecond, the duration of a period W3 is 2 microseconds, the duration of a period W4 is 5 microseconds, the duration of a period W6 is 7 mlcroseconds, and the duration of a period W7 is 2 microseconds. In addition, a voltage delta1 is −5V, and a voltage delta2 is 15V.

As a result of experiments using the liquid ejection head set as above, the amount of a first droplet ejected in the first cycle was 1.4 pl and the ejection speed was 6.4 m/s. The amount of a second droplet ejected in the second cycle was 1.4 pl and the ejection speed was 6.8 m/s. The amount of a third droplet ejected in the fourth cycle was 1.4 pl and the ejection speed was 6.4 m/s, because the liquid ejection head returned to almost the same state as that in the first cycle in which the first droplet was ejected.

Figure 15:
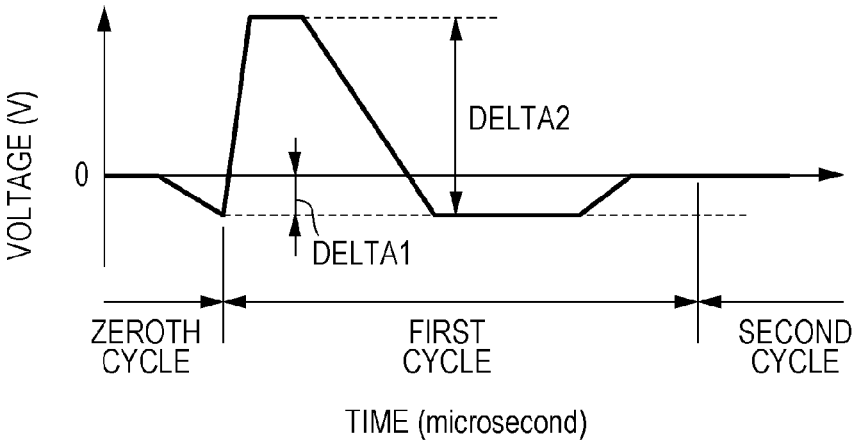
FIG. 15 illustrates a waveform of a voltage applied to a piezoelectric element of a liquid ejection head according to a modification obtained by modifying the piezoelectric element of the liquid ejection head according to the third embodiment.

FIG. 15 is a graph illustrating a waveform of a voltage applied to the piezoelectric element 13 for the case where a droplet is ejected in the first cycle and a droplet is not ejected in the second cycle. The waveform in the zeroth, first, and second cycles in FIG. 15 is similar to that in the zeroth, second, and third cycles in FIG. 13. Thus, a droplet is ejected in the first cycle in FIG. 15, but a droplet is not ejected in the second cycle in FIG. 15.

With the method of driving a liquid ejection head 2*b* according to the embodiment, the liquid ejection head 2*b* can favorably perform ejecting operations even when the primary cycle in which a droplet is ejected and the secondary cycle in which a droplet is not ejected coexist. Even when a liquid ejection head is driven at a high frequency (46.5 kHz) to eject a liquid having the viscosity of 40 cP, the liquid ejection head 2*b* can favorably perform ejecting operations.

With the method of driving a liquid ejection head 2*b* according to the embodiment, the amount of a droplet in a single ejection falls within a range of 1.3 to 1.4 pl and the ejection speed falls within a range of 6.2 to 6.8 m/s. Thus, with the method of driving a liquid ejection head 2*b* according to the embodiment, droplets can be ejected stably.

Since the first flow path 10 is subjected to the liquid repelling treatment with the method according to the embodiment, the liquid is less likely to flow through the first flow path 10 having a high flow resistance. Thus, the piezoelectric element 13 is allowed to be driven by a low voltage and the liquid ejection head 2*b* has a longer life.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-093070, filed Apr. 19, 2011, which is hereby incorporated by reference herein in its entirety.

The invention claimed is:

1. A method of driving a liquid ejection head comprising:

preparing a liquid ejection head that includes a first flow path having a first end serving as an orifice, a second flow path connected to a second end of the first flow path and having a larger cross-sectional area than that of the first flow path, the first flow path and the second flow path being connected by step parts, and a piezoelectric element provided so as to correspond to the second flow path, the liquid ejection head repeating cycles in each of which the liquid ejection head is capable of ejecting a droplet from the orifice by applying a voltage having a predetermined waveform to the piezoelectric element, the cycles including a primary cycle in which a droplet is ejected from the orifice and a secondary cycle in which a droplet is not ejected from the orifice;

a first applying step of applying, in the primary cycle, a first voltage, which increases a capacity of the second flow path, to the piezoelectric element so that a meniscus of a liquid that is formed in the first flow path in a static state is moved to an inside of the second flow path beyond the step parts;

a second applying step of applying, in the primary cycle, a second voltage, which decreases the capacity of the second flow path, to the piezoelectric element so that the liquid in the second flow path flows into the first flow path;

a third applying step of applying, in the primary cycle, a third voltage to the piezoelectric element so that the liquid having flowed into the first flow path in the second step is ejected from the orifice and a meniscus of the liquid is formed in the second flow path beyond the first flow path and the step parts;

a fourth applying step of applying, in a state where the meniscus of the liquid is positioned in the second flow path, a fourth voltage, which decreases the capacity of the second flow path, to the piezoelectric element; and a fifth applying step of applying a fifth voltage, which increases the capacity of the second flow path, to the piezoelectric element to eject the liquid.

2. The method according to claim 1, wherein at a timing when the liquid projects from the orifice in the second applying step, the first voltage is applied to the piezoelectric element in the third applying step.

3. The method according to claim 1, wherein, in any one of the cycles that is the primary cycle followed by a subsequent cycle that is the primary cycle, after the third applying step is performed in the any one of the cycles, the second flow path is refilled with the liquid, and then the first applying step of the subsequent cycle is started.

4. The method according to claim 1, wherein, in any one of the cycles that is the primary cycle followed by a subsequent cycle that is the secondary cycle, after the third applying step is performed in the any one of the cycles, the liquid ejection head is maintained at an initial state at which no voltage is applied to the piezoelectric element during a period from when the liquid ejection head returns to the initial state to when the subsequent cycle is started.

5. The method according to claim 1, wherein, in any one of the cycles that is the secondary cycle followed by a subsequent cycle that is the primary cycle, the first voltage is applied to the piezoelectric element until the subsequent cycle is started, and then the first applying step of the subsequent cycle is started.

6. The method according to claim 1, wherein, in any one of the cycles that is the secondary cycle followed by a subsequent cycle that is the secondary cycle, the liquid ejection head is maintained at an initial state at which no voltage is applied to the piezoelectric element.

7. The method according to claim 1, wherein the first voltage is equal to the third voltage.

8. The method according to claim 1, wherein a potential difference of the first voltage is smaller than a potential difference of the third voltage.

9. A liquid ejection apparatus comprising:

a controller that controls the liquid ejection head with the method according to claim 1.

10. The liquid ejection apparatus according to claim 9, wherein an inner wall surface of the first flow path is subjected to a liquid repelling treatment.

11. A method of driving a liquid ejection head, comprising:

preparing a liquid ejection head that includes an orifice through which a liquid is ejected, a first flow path having a first end connected to the orifice, a second flow path connected to a second end of the first flow path that is opposite the first end and having a larger cross-sectional area than that of the first flow path, the first flow path and the second flow path being connected by step parts, and a piezoelectric element provided so as to correspond to the second flow path, the piezoelectric element allowing a droplet to be ejected from the orifice by changing a capacity of the second flow path with a voltage having a predetermined waveform being applied to the piezoelectric element;

a first applying step of applying a first voltage, which increases the capacity of the second flow path, to the piezoelectric element so that a meniscus of a liquid that is formed in the first flow path in a static state is moved to an inside of the second flow path beyond the step parts;

a second applying step of applying a second voltage, which decreases the capacity of the second flow path, to the piezoelectric element while the meniscus is positioned in the second flow path to move the liquid to an inside of the first flow path;

a third applying step of applying a third voltage, which increases the capacity of the second flow path, to the piezoelectric element to eject the liquid from the orifice after the liquid in the first flow path projects from the orifice;

a fourth applying step of applying, in a state where the meniscus is positioned in the second flow path, a fourth voltage, which decreases the capacity of the second flow path, to the piezoelectric element; and a fifth applying step of applying a fifth voltage, which increases the capacity of the second flow path, to the piezoelectric element to eject the liquid.

12. The method according to claim 11, wherein the first voltage is equal to the third voltage.

13. The method according to claim 11, wherein a potential difference of the first voltage is smaller than a potential difference of the third voltage.

* * * * *